United States Patent [19]

Grieve et al.

[11] 4,246,576

[45] Jan. 20, 1981

[54] CYCLONE MONITORING APPARATUS AND METHOD

[75] Inventors: Donald F. Grieve, LaHonda; Edward D. Barnett, Sunnyvale, both of Calif.

[73] Assignee: Krebs Engineers, Menlo Park, Calif.

[21] Appl. No.: 33,704

[22] Filed: Apr. 26, 1979

Related U.S. Application Data

[63] Continuation-in-part of Ser. No. 873,275, Jan. 30, 1978, abandoned, which is a continuation-in-part of Ser. No. 781,141, Mar. 25, 1977, abandoned.

[51] Int. Cl.[3] ..... G08B 21/00

[52] U.S. Cl. ..... 340/606; 241/34

[58] Field of Search ..... 340/518, 606, 608, 610, 340/309.1; 241/34

[56] References Cited

U.S. PATENT DOCUMENTS

| | | | |
|---|---|---|---|
| 3,114,510 | 12/1963 | McCarty et al. | 241/34 |
| 3,284,788 | 11/1966 | Hudson | 340/606 X |
| 3,314,059 | 4/1967 | Hill et al. | 328/90 |
| 3,493,951 | 2/1970 | Hartka et al. | 340/606 |
| 3,599,195 | 8/1971 | Boyko | 340/309.1 |

*Primary Examiner*—Donald J. Yusko

*Assistant Examiner*—Daniel Myer

*Attorney, Agent, or Firm*—Flehr, Hohbach, Test, Albritton & Herbert

[57] ABSTRACT

An apparatus and method for monitoring the operation of centrifugal cyclones. Sensing means is disposed in the underflow spray discharge of a cyclone and is connected to electronic sensing circuitry adapted to produce a signal or alarm response when the cyclone ceases to operate in a normal manner. In one embodiment the apparatus and method employs a plurality of cyclones connected to receive feed material from a common manifolding means. Abnormal functioning of one cyclone of the group is immediately indicated by visual or audible alarm means and thereafter its sensing means may be disabled to permit the sensing circuitry to continue to be effective for the remaining cyclones. Delay means is incorporated in the circuitry to prevent a response when the abnormal condition is of short duration. One form of sensing means employs a probe which extends into the normal underflow discharge spray. Another form employs a paddle and switch assembly, with the paddle extending into the normal discharge spray.

7 Claims, 8 Drawing Figures

FIG.—5
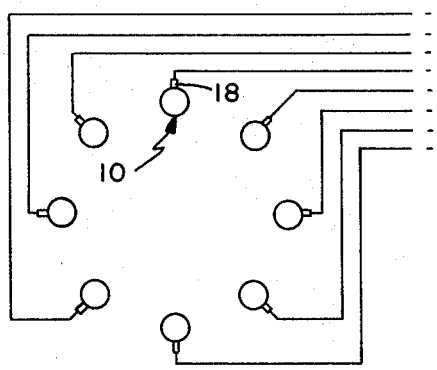
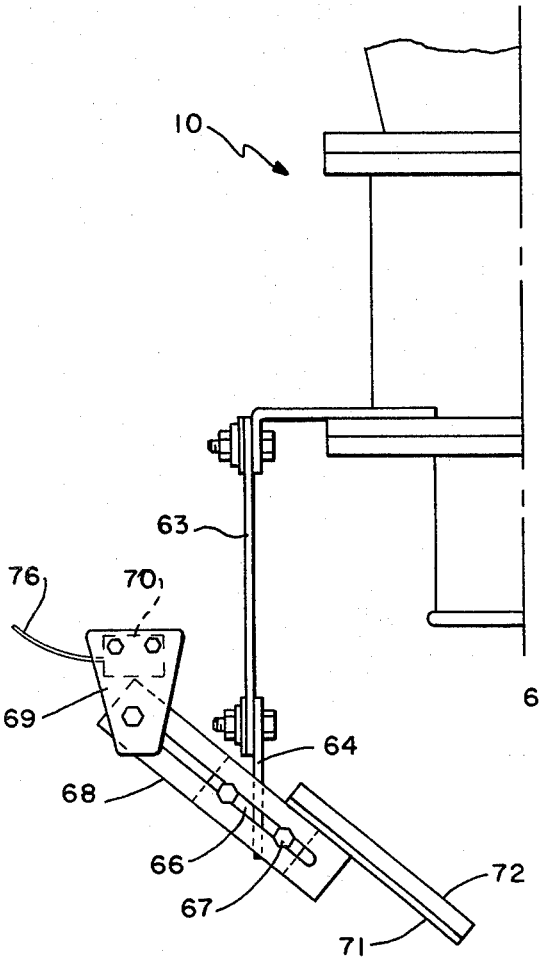
FIG.—7
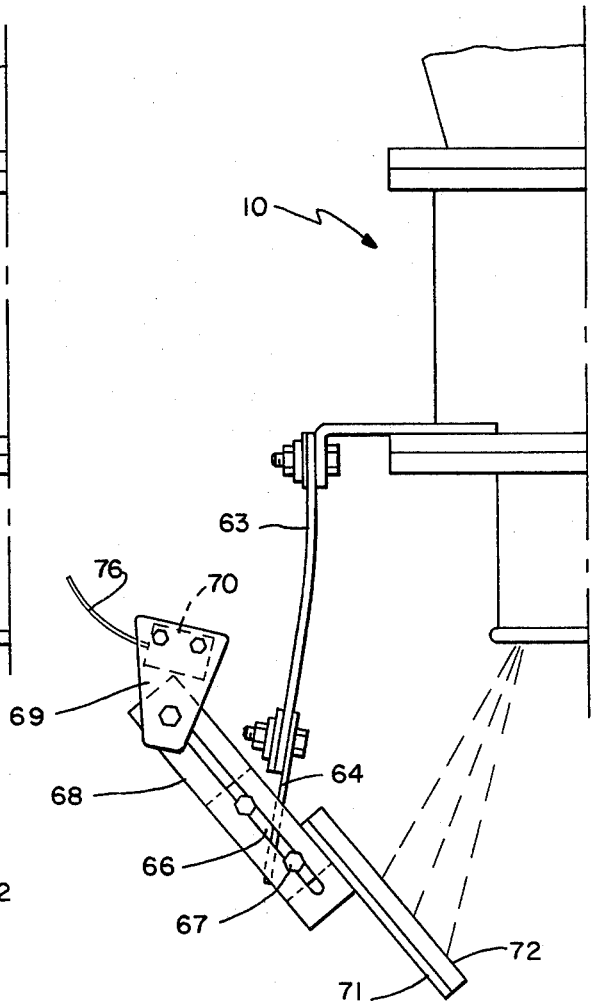
FIG.—8

CYCLONE MONITORING APPARATUS AND METHOD

CROSS-REFERENCE TO COPENDING APPLICATION

This application is a continuation-in-part of our copending application Ser. No. 873,275 filed Jan. 30, 1978 (now abandoned), which is a continuation-in-part of our application Ser. No. 781,141 filed Mar. 25, 1977 (now abandoned).

BACKGROUND OF THE INVENTION

This invention relates generally to apparatus and methods for monitoring the operation of cyclones of the type adapted to carry out centrifugal separating operations.

Cyclones such as are employed for effecting centrifugal separation operations on a variety of feed materials, such as pulps and slurries, are customarily made with a cylindrical body section having a tangentially disposed feed inlet and a lower conical shaped body section terminating in an apex having an underflow orifice. The overflow is discharged through a centrally located pipe or vortex finder. In normal operations swirling movement is imparted to the body of material within the cyclone, whereby separating forces cause heavier components of the feed to be separated and discharged through the underflow orifice, with an overflow being continuously discharged through the vortex finder. Normally the underflow is discharged as a spray having a hollow conical shaped pattern or configuration. Various abnormal operating conditions serve to prevent the discharge of the underflow in the normal pattern. For example, oversized rocks or lumps in the feed material may choke or partially choke the underflow discharge orifice, thus interferring with the development of the usual conical spray pattern. Also under certain conditions, such as improper loading, material is discharged from the underflow orifices as a solid stream or rope. In the various industries where such separating cyclones are employed it is important to detect malfunctioning of a cyclone, and to disconnect it from the system, without interferring with the operation of other cyclones which may be incorporated in the system. In some instances one or more cyclones are connected to a closed circuit milling system, such as a ball or other grinding mill circuit operating on ore solids to produce a pulp or slurry of suitable concentration. In such a system abnormal operation that is visually noted may enable the operator to correct operation of the milling system and thus restore proper loading of the cyclones.

U.S. Pat. No. 3,114,510 granted Dec. 17, 1963, discloses means making use of conductive probes in the form of insulated rods extending into the underflow spray pattern of a cyclone, and connected to circuitry which provides a signal response in the event there is a substantial change in the spray pattern. The input to the circuitry in that instance employs three insulated conductors, one being connected to the metal body of the cyclone and the other two to the probes. The tip end of the probes, which are uninsulated, are disposed adjacent the inner and outer peripheries of the hollow conical shaped spray. A substantial change in the resistivity between one probe and the metal body of the cyclone indicates a change in the spray pattern such that the spray is no longer enveloping the tip end of that probe. Likewise, a change in the resistance between the tip end of the other probe and the body of the cyclone indicates a change in that boundary of the pattern with which that particular probe is associated. As disclosed in said patent, the associated circuitry serves to generate a response signal which may be used to control the feed to a grinding mill which is employed to reduce the particle size of the feed solids, and thus adjust the loading of the cyclone. Also the patent shows use of a generated signal for adjusting valve means for controlling the rate of discharge of underflow material.

SUMMARY OF THE INVENTION AND OBJECTS

In general it is an object of the invention to provide improved means for monitoring the operation of one or more cyclones whereby an operator, who may be at a remote station, is apprised of abnormal conditions.

Another object is to provide cyclone monitoring means which is applicable to a number of cyclones connected to receive feed from common manifolding. The arrangement is such that a single circuitry can be used to monitor a plurality of such cyclones, and one or more cyclones may be disabled while permitting the other cyclones to continue operation with monitoring.

Another object is to provide monitoring means for cyclones which avoids a valve alarm or signal response when the abnormal condition (e.g., actual choking) is relatively of short duration, as for example, for only a few seconds.

Another object is to provide cyclone monitoring means which during normal cyclone operation will ignore momentary interruptions of the sensing circuit employed.

Another object is to provide a monitoring arrangement making use of circuitry which is immune to spurious signal which might otherwise be induced by nearby electrical equipment, such as pump motors, mill motors and the like.

Another object is to provide a novel method for the monitoring of cyclones making use of the disclosed apparatus.

In general the present invention is employed in connection with equipment such as one or more cyclones of the type adapted to receive a pulp or slurry feed to effect centrifugal separation, with discharge of an overflow and an underflow, the underflow for normal operation being a spray having a hollow conical configuration. In one embodiment an electrically conducting probe is disposed adjacent the underflow discharge orifice of an associated cyclone in such a position that it is within the spray pattern and whereby the discharging underflow material establishes a conductive path to the probe. Electrical circuitry is connected to the probe for producing a visual or audible alarm in response to an increase in the electrical resistivity of the path beyond a predetermined value. The apparatus can be installed in conjunction with a plurality of cyclones receiving feed from common manifolding. Each such cyclone is provided with a probe, and the probes are connected to a common circuitry. In the event of abnormal operation of one of the cyclones of the group with energizing of the alarm means, means is provided whereby its probe can be effectively disabled, without interrupting continued operation of the other cyclones and their continued monitoring. The apparatus preferably incorporates delay means whereby the alarm is not energized if the abnormal condition persists for only a short time. In another embodiment the sensing means consists of a paddle-like probe disposed within the spray pattern and serving to control the operation of the electrical switch. The circuitry in that instance is connected to the switch contacts. The invention also includes a method making use of such apparatus.

Additional objects and features of the invention will appear from the following description in which the preferred embodiment has been set forth in detail in conjunction with the accompanying drawing.

BRIEF DESCRIPTION OF THE DRAWING

FIG. 5 is a schematic diagram showing a plurality of cyclones forming a cluster fed from a common manifold.

FIG. 7 is a side elevation showing another embodiment of the sensing means or probe assembly.

FIG. 8 is like FIG. 7 but shows the paddle-like probe in a different operating position.

DESCRIPTION OF THE PREFERRED EMBODIMENTS

Figure 1:
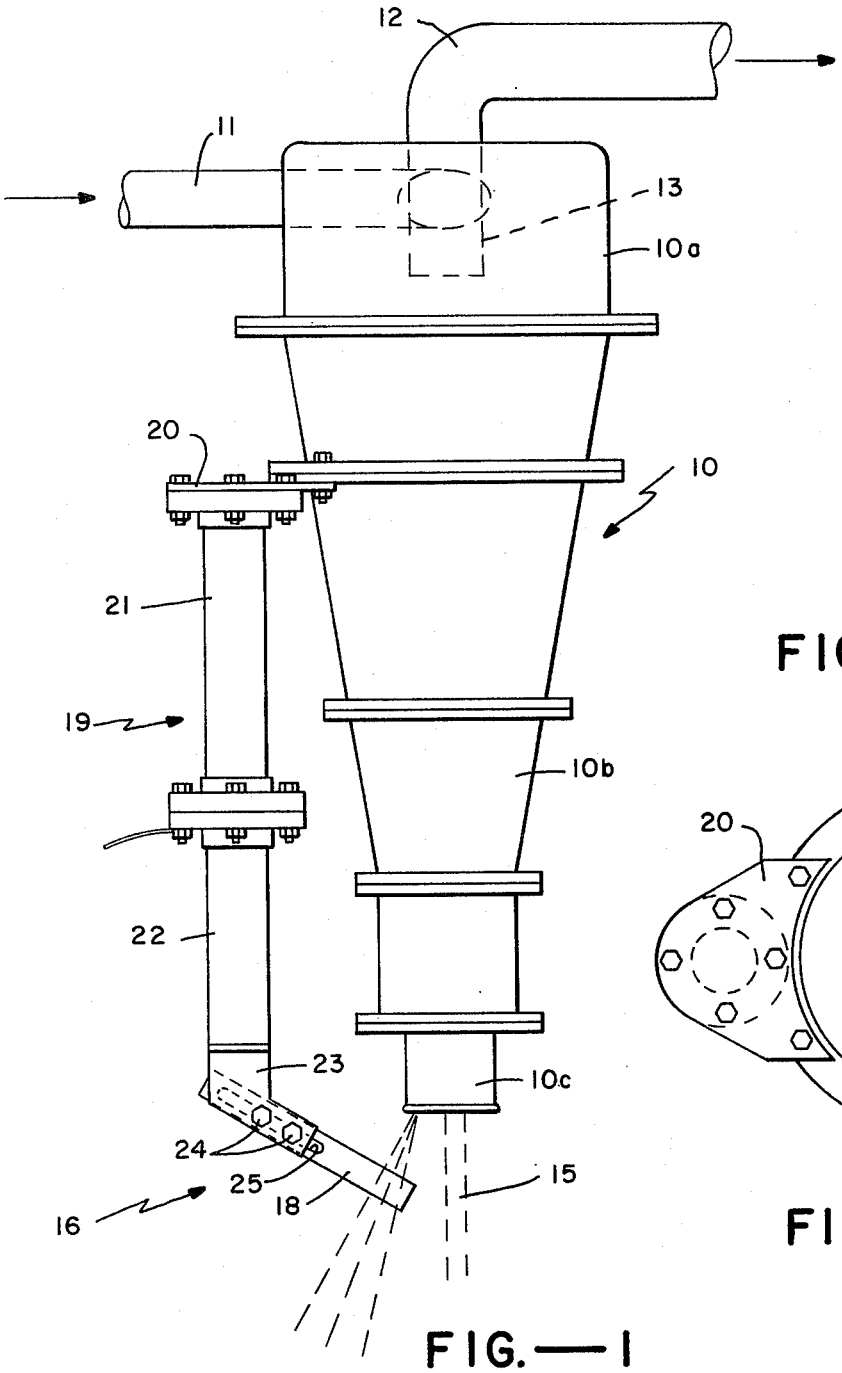
FIG. 1 is a side elevational view illustrating a probe assembly mounted upon a cyclone.

The cyclone illustrated in FIG. 1 is a conventional construction, consisting of a body 10 having an upper cylindrical part 10*a*, a conical shaped part 10*b* and a lower apex part 10*c*. The conical part 10*b* may be made in a plurality of sections that are bolted together as illustrated. The upper body part receives feed material through tangentially connected pipe 11. The overflow pipe 12 connects with the inner vortex finder 13, which extends axially within the body. The lower apex part 10*c* has an orifice through which the underflow discharges. Swirling movement of the material within the body creates centrifugal forces which cause separation of heavier components, whereby the heavier components are discharged in an underflow from the apex orifice, while the remaining material is discharged as an overflow through the pipe 12. By way of example, the feed pumped to the cyclone through pipe 11 may be a pulp or slurry such as is produced by the grinding of metallurgical ores. Also in some instances, as in the paper pulp industry, the slurry may be a pulp containing cellulose fiber together with contaminating solid particles which are to be separated. The separating action may simply produce an underflow concentrate, or it may result in classification of solids having different separating characteristics. When operated as a classifier heavier components of the ore solids are discharged in the underflow, and lighter solids are discharged in the overflow. Generally such cyclones are operated in vertical position, although in some instances they are inclined or may be operated horizontally. Irrespective of the type of pulp or slurry being handled, and whether operation is for simple separation or classification, the underflow discharge of a normally operating cyclone is a hollow conical spray. Such a spray is indicated schematically at 14 in FIG. 1. Abnormal operation of the cyclone causes the discharging underflow to depart from its conical pattern, and in such instances the discharge may be broken or erratic, or it may be a solid stream as indicated at 15 in FIG. 1, in which event the condition is termed roping. Also during normal operation the underflow may be subject to momentary variations in density, size distribution of the solids, and discharge velocity.

Figure 3:
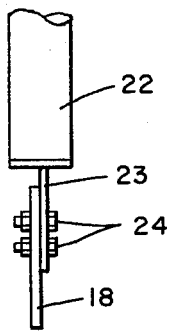
FIG. 3 is an enlarged side elevational view of the lower portion of the probe assembly.
Figure 4:
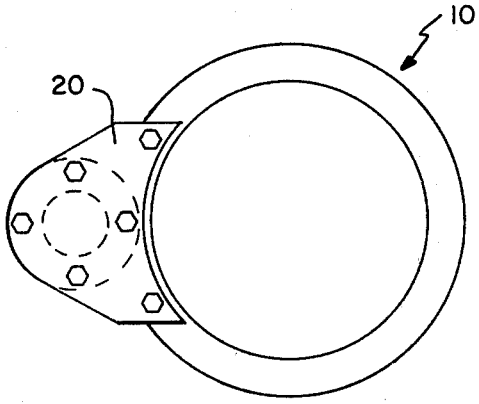
FIG. 4 is a plan view of the probe assembly.

For the purpose of monitoring operation of the cyclone to detect abnormal operation, a probe assembly 16 such as shown in FIGS. 1, 3 and 4 can be employed. The assembly includes an electrically conductive probe 18 which may be in the form of a metal bar made of suitable metal, metal alloy or other conducting material capable of resisting erosion. The probe is secured to a suitable mounting means 19 which in turn is suitably attached to the cyclone. In practice the bar may have a width of the order of $\frac{3}{4}$ to $1\frac{1}{4}$ inch and a thickness of about $\frac{1}{4}$ to $\frac{3}{8}$ inches. As shown in FIG. 1 the probe bar 18 is in a plane extending substantially parallel to the direction of movement of the spray particles, and the free end of the probe extends well within the spray pattern. When so positioned the spray continually wets the upper edge and the side surfaces of the probe. Because of small amounts of chemical that are always present in industrial pulps and slurries, they are electrically conductive, and when the spray underflow discharge assumes its normal pattern, there is relatively constant electrical conductivity between the probes and the grounded metal body of the cyclone. In a typical instance, where the slurry being acted upon consists of a slurry of ore solids, the resistance between the probes 18 and the cyclone body may be of the order of 25 to 50 kilohms. However, under abnormal operation of the cyclone the resistance may be many times this value.

The probe assembly 16 as shown includes a mounting plate 20 that may be attached by bolts to mating flanges between sections of the conical part 10*b*. A tube or pipe 21 of insulating material has its upper end fixed to the plate 20. A metal extension pipe 22 has its upper end fixed to the lower end of pipe 21 and its lower end carries a plate 23. The bar 18 is secured to plate 23 as by bolts 24. The bar 18 is provided with a slot 25 through which the bolts 24 pass to permit the position of bar 18 to be adjusted. The bar 18 is inclined downwardly as for example at an angle of 45° to the axis of the cyclone.

Figure 2:
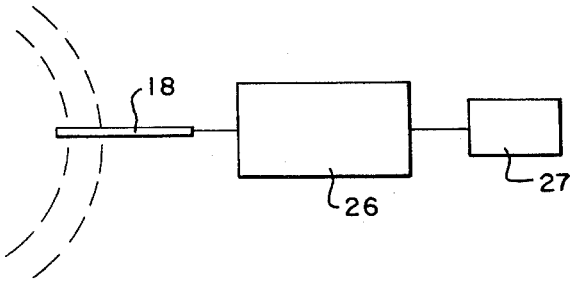
FIG. 2 is a schematic view having a single probe connected to electronic circuitry.

In conjunction with the probe assembly 16 an electronic circuitry is provided which generates a signal for the operation of a visual and/or audible alarm when the resistance of the path between the probe and the cyclone body increases beyond a predetermined value. In FIG. 2 the electronic circuitry is indicated generally at 26, and is shown being connected to a visual and/or sound alarm device 27. Assuming that the electronic circuitry 26 has proper sensitivity and can be adjusted to provide a response signal for operation of alarm 27, when the resistance of the path between the probe 18 and the body of the cyclone increases beyond a predetermined value (e.g., more than twice normal resistance), then such an arrangement can be used to indicate abnormal operation of the cyclone. Under abnormal conditions the spray pattern no longer forms a path between the probes of sufficient electrical conductivity to avoid a signal response. As previously mentioned, such abnormal operation may be caused by lumps or fragments which partially or completely choke the underflow discharge orifice. Also it may be caused by improper loading of the cyclone, or by abnormal changes in the density of the feed.

FIG. 5 illustrates the probes incorporated with a plurality of cyclones all having their inflow pipes connected to common manifolding. The cyclones 10 are each provided with a probe assembly 16, and the probe 18 of each assembly is connected by a lead to the circuitry shown in FIG. 6.

Figure 6:
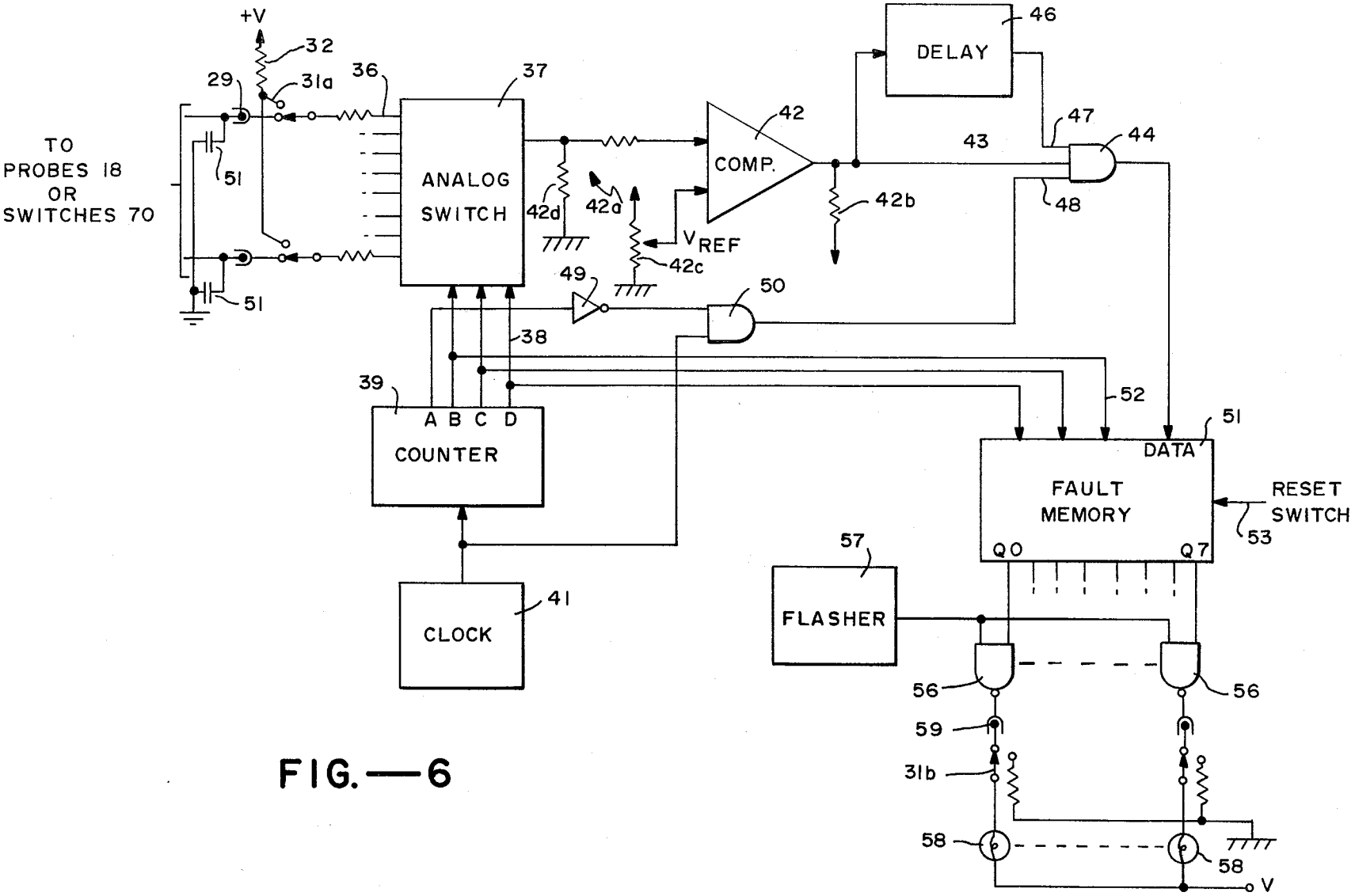
FIG. 6 is a block diagram of suitable circuitry.

FIG. 6 shows the lines leading from probes 18 being connected by jacks 29 and switches 31*a* to the inputs 36 of the analog switch 37. Switches 31*a* enable individual cyclones to be isolated from the alarm circuitry if desired. When a switch is closed the corresponding lead to analog switch 37 is connected to a voltage source through resistor 32, thus effectively shorting out that particular probe. The analog switch in this instance comprises a multiplexor which receives address signals on lines 38 from a counter 39. In the embodiment illustrated, counter 39 is an 8-bit binary counter which receives clock pulses from a clock oscillator 41. The clock oscillator is of known design for producing generally rectangular pulses of suitable width and rate, e.g., 250 nanosecond pulses at a rate of 400 KHz.

The output of analog switch 37 is connected to one input of a voltage comparator 42. A reference voltage $V_{REF}$ is applied to a second input of the comparator from a suitable source. In the preferred embodiment, the reference source is adjustable to accommodate different operating conditions, as by use of the potentiometer 42*c*. The output line from switch 37 connects to the comparator through the voltage divider 42*a* and the output line from the comparator is shown connected to a voltage source through resistor 42*b*.

The output of comparator 42 is connected to one input 43 of a coincidence gate 44 and to the input of a circuit 46. The delay circuit comprises a timing circuit of known design for delivering an output pulse of a predetermined time after receipt of an input pulse. A delay on the order of 3 seconds has been found to provide a satisfactory discrimination against temporary disturbances due to factors such as splashing of the slurry, momentary blockage of the cyclone orifice or electrical noise. The output of the delay circuit is connected to a second input 47 of gate 44.

Sampling pulses derived from the clock pulses are applied to a third input 48 of gate 44 by an inverter 49 and an AND gate 50. As illustrated, the input of the inverter is connected to the least significant bit output of counter 39, and the output of the inverter is connected to one input of AND gate 50. Gate 50 receives a second input from clock oscillator 41 and delivers the sampling pulses to input 48 of gate 44. The sampling pulses occur at one-half of the clock rate and toward the center of the scan of each probe.

The output of gate 44 is connected to the data input of a fault memory 51. In the preferred embodiment memory comprises a plurality of addressable latches which receive address signals from counter 39 via address inputs 52. Being addressed by the same signals as the multiplexor of analog switch 37, the latches are addressed in synchronization with the scanning of probes 18. Reset signals can be applied to the memory on a line 53 from one or more suitable sources, not shown, for the purpose of clearing the latches.

The outputs 54 of the fault memory are connected to the inputs of NAND gates 56, one such gate being provided for each of the latches. Each gate also receives a second input from a flasher 57. In the preferred embodiment, the flasher comprises a conventional bistable oscillator operating at a suitable frequency such as 1 Hz. The output signal from NAND gates 56 control the operation of indicator lamps 58 which provide alarm means.

Connecting jacks 59 are shown in the leads from the fault memory 51. Preferably shorting switches 31*b* are provided for shorting out a particular lead to ground. Preferably switches 31*a* and 31*b* are interconnected, as by mechanical means, for conjoint operation. The lamps 58 together with the shorting switches preferably are incorporated in a unit that is remote from the cyclones. Also the entire circuitry of FIG. 6 may be at a remote station.

Preferably additional delay means is provided in conjunction with the input circuitry connected to the analog switch 37. Thus a capacitor 51 connects between each probe lead and ground. The value of each capacitor is such (e.g., 4.7$\mu$) that interruptions of voltage on a lead for periods less than the delay time (e.g., 3 seconds) provided by means 46 (e.g., 2 seconds) are ignored.

Operation of the circuit of FIG. 6 is as follows. The signals from probes 18 are scanned successively by analog switch 37 in accordance with the address signals from counter 39. When operative disconnection occurs between a probe 18 and lead 36 the voltage developed across resistor 42*d* of the voltage comparator 42*a* falls to zero. Eacn successive probe signal is compared with the reference signal $V_{REF}$. In the event that a probe signal drops below the level of the reference signal in response to a decrease in the underflow discharge, comparator 42 delivers an output pulse to gate 44 and to delay network 46. Three seconds later, the delay network delivers a second pulse to gate 44. Upon conjoint receipt of pulses from the comparator, delay network and gate 50, the gate 44 delivers an output pulse to the fault memory 51. This signal is stored in the memory latch selected by the address signals then present on lines 52. Since the memory is addressed in synchronization with the analog switch, the signal is stored in the latch corresponding to the probe which detected the decrease in the underflow discharge. The presence of a signal in one of the latches enables the corresponding NAND gate 56 to pass the signal from flasher 57, and the lamp 58 connected to the enabled gate flashes and the flashing of the corresponding lamp 58 indicates which probe is sensing the decreased slurry flow. The flashing rate may be one flash per second. The corresponding shorting switches 31*a* and 31*b* may then be closed to permit servicing of a malfunctioning cyclone or its replacement, without interferring with monitoring of the remaining cyclones.

The manner in which the probe is mounted avoids possible short circuiting and false operation due to splashing of the discharging material. This is because the insulating pipe 21 is well above the zone near the apex end of the cyclone where splashing is apt to occur.

Interruptions of the voltage on a probe lead such as may occur during normal operation of the cyclone are ignored due to the functioning of capacitors 51. During voltage interruptions of very short duration (e.g., 2 seconds or less) the normally charged capacitors have a discharge leak rate sufficient to maintain the voltage. Leakage is provided because of leak resistance inherent in the analog switching means.

The probe assembly shown in FIGS. 1, 3–5 is desirable for many operating conditions, including instances where the cyclone is inclined or disposed horizontally. However, in some instances it may be desirable to use the paddle-like probe shown in FIGS. 7 and 8, particularly when the cyclone is operated in a vertical position. The probe assembly in this instance consists of a mounting plate 62, similar to the plate 20 of FIG. 1, which is secured to the upper end of a flat flexible strip 63 that is made of insulating material. The lower end of the strip 63 is secured to member 64, which in turn is secured to a plate 66 that is adjustably secured by bolts 67 to the bar 68. One end of this bar carries a counterweight 69 on which the switch 70 is mounted. The other end is secured to plate 71, which serves to mount a spray impact member 72, preferably made of wear resistant refractory material such as carborundum. Member 72 may for example have a width of the order of 3 inches, and a length in the direction of the bar 66 of the order of 4½ inches.

The switch 70 mounted upon the counterweight 69 may be of the mercury type which is operated by tilting. When the cyclone is not in operation strip 63 is vertical and the impact member 72 is disposed at an angle to the horizontal, as for example, about 45°. However, the impact member is positioned within the norml pattern of the discharging underflow spray when the cyclone is in operation.

FIG. 8 illustrates the cyclone in operation, at which time the discharging spray impacts member 72 and deflects this member in the manner illustrated, with flexing of the strip 63. The resulting tilting of the switch 70 causes the switch contacts to be closed. The switch is connected to the circuitry of FIG. 6 in substantially the same manner as the probe previously described. Assuming that several cyclones having assemblies as shown in FIGS. 7 and 8 are incorporated in the system, the lead 76 from each of the switches 70 is connected to the analog switch 37 through a jack 29, and the other side of the switch is grounded. When each switch 70 has its contacts closed due to its tilted position, with the impact member 72 being substantially in the position shown in FIG. 8, the alarm devices of FIG. 6 are not energized. However, if one of the cyclones ceases to operate in a normal manner, thus interrupting discharge of underflow in the normal spray pattern, the impact member 72 is permitted to move to a position comparable to that shown in FIG. 6 whereby the switch 70 is positioned to open its contacts, thus causing an alarm response as previously described to indicate the particular cyclone which is malfunctioning.

When using the paddle-like probe means of FIGS. 1, 3–5, the delay means 46 and the capacitors 51 function as previously described. It has been observed that during normal cyclone operation the probe may be subject to swinging movements or "dancing", presumably due to momentary changes in the forces applied to the probe. Such swinging or dancing of the probe causes momentary opening of the switch contacts which causes voltage on the probe head momentarily to drop to zero. Such circuit interruptions with loss of lead voltage are of short duration (e.g., 2 seconds or less), and thus during such intervals voltage on the probe leads is maintained by the capacitors 51, and in effect, such circuit interruptions are ignored.

What is claimed is:

1. In apparatus for monitoring the operation of a hydrocyclone from which a conical spray of heavier underflow material is continuously discharging, sensing means responsive to abnormal operation of the cyclone which interrupts the normal conical spray pattern of the discharging material, said means comprising an assembly having a probe extending into the spray pattern, a sensing circuit controlled by the sensing means, the circuit including a path that is electrically conductive when the underflow is discharged in a normal spray pattern and which is substantially reduced in conductivity when the underflow discharge pattern is interrupted or becomes abnormal, and electrical circuitry connected to said path, said circuitry comprising switching means serving cyclically to momentarily apply a predetermined voltage across the conductive path established by the probe, a comparator for generating a signal, the inputs of the comparator being connected to the output of the switching means and also to a source of reference voltage whereby the voltage of each probe is sequentially applied to the comparator by the switching means, the comparator serving to apply an output pulse when the voltage applied from the switching means is less than the reference voltage, time delay means connected to receive each output pulse from the comparator and to deliver an output pulse after a predetermined time delay, a plurality of indicators adapted to be energized to indicate faulty operation of a cyclone, and means for energizing an indicator corresponding to a particular cyclone when the voltage on the probe is such that it causes the delay means to deliver an output pulse.

2. Apparatus as in claim 1 in which the sensing means consists of an electrical conducting probe having its one end portion uninsulated and positioned to extend well within the pattern of the discharging material whereby the discharging material continually wets the upper and side surfaces of the probe and whereby a conductive path is established through the material to the one end portion of the probe, said conductive path being connected to said electrical circuitry.

3. Apparatus as in claim 1 in which said sensing means is an assembly comprising a probe having an impact member disposed within the normal spray pattern and forming a surface area impacted by the discharging spray, a bar having one end of the same attached to said impact member, means for supporting the bar whereby the bar may tilt between a first position in which the impact member is within a spray pattern to a second position in which the angularity of the bar relative to the horizontal is increased, said last means serving to yieldably urge the bar toward said first position, and electrical switching means carried by the bar and operated by tilting of the bar for opening or closing an electrical path responsive to movement of the impact member between said two positions, said circuitry being connected to said switching means whereby opening or closing of the switching means produces a response in said circuitry.

4. Apparatus as in claim 3 together with a capacitor connected across the switching means carried by the bar, the capacitance value of the capacitor being such that voltage is maintained across the switching means during momentary open periods that are less than the time period of said delay means.

5. Apparatus as in claim 1 together with capacitor means in that part of the circuitry connecting the probe to the switching means for preventing momentary loss of voltage for periods of time less than the time delay afforded by said time delay means.

6. Apparatus as in claim 4 in which said capacitor means is a capacitor connected across the conductive path established by the probe.

7. In apparatus for monitoring the operation of a hydrocyclone, a sensing assembly comprising a probe having a member disposed within the conical spray pattern and forming an impact surface area that is impacted by the discharging spray, a bar having one end of the same attached to said member, means for supporting the bar whereby the bar together with said member may tilt between a first position in which the impact member is within the spray pattern to a second position in which the angularity of the bar relative to the horizontal is increased, said means serving to yieldably urge the bar toward said first position, an electrical switching means operated by changes in the angularity of said bar for opening or closing an electrical path, and electrical indicating circuitry connected to said path.

* * * * *